United States Patent [19]

Binoche

[11] 4,232,824

[45] Nov. 11, 1980

[54] METHOD AND APPARATUS FOR THE PNEUMATIC SPRAYING OF LIQUID PRODUCTS

[75] Inventor: Michel Binoche, Paris, France

[73] Assignee: S K M, Societe Anonyme, Staines, France

[21] Appl. No.: 886,360

[22] Filed: Mar. 14, 1978

[30] Foreign Application Priority Data

Mar. 22, 1977 [FR] France ..... 77 08469

[51] Int. Cl.[3] ..... B05B 7/08

[52] U.S. Cl. ..... 239/8; 239/296; 239/599

[58] Field of Search ..... 239/8, 290, 296, 297, 239/299, 300, 424.5, 599, 597

[56] References Cited

U.S. PATENT DOCUMENTS

| | | | |
|---|---|---|---|
| 2,569,251 | 9/1951 | Nieburg | 239/297 X |
| 2,587,993 | 3/1952 | Gray | 239/296 |
| 3,252,657 | 5/1966 | Winegar | 239/296 |
| 3,521,824 | 7/1970 | Wilcox | 239/299 X |
| 3,843,052 | 10/1974 | Cowan | 239/296 X |

FOREIGN PATENT DOCUMENTS

| | | | |
|---|---|---|---|
| 2303603 | 10/1976 | France | 239/296 |

*Primary Examiner*—Robert W. Saifer

[57] ABSTRACT

This pneumatic spray gun for atomizing paint comprises a flat-jet nozzle of the type utilized in hydrostatic atomization spray guns, this nozzle being surrounded by compressed-air jets disposed symmetrically and parallel to the flat jet of paint so as to envelope and drive same, other compressed-air jets being disposed symmetrically in a plane perpendicular to the flat jet of paint and converging thereagainst, whereby a satisfactory atomization is obtained which precludes not only the detrimental high pressure values of hydrostatic atomization, but also the considerable output of compressed air of conventional pneumatic atomization and the attendant losses of paint and other inconveniences deriving therefrom.

4 Claims, 22 Drawing Figures

METHOD AND APPARATUS FOR THE PNEUMATIC SPRAYING OF LIQUID PRODUCTS

FIELDS OF THE INVENTION

The present invention is directed to provide a novel method of atomizing liquid products and also to an improved spray gun for carrying out this method. The method and spray gun according to this invention are intended more particularly but not exclusively for atomizing and spraying paints and varnishes. In the following disclosure, only paint will be mentioned for the sake of simplification, but it will readily occur to those conversant with the art that any other liquid may be atomized and sprayed by using the method and spray gun according to the instant invention.

BACKGROUND OF THE INVENTION

For many years various methods of spraying paint by means of jets of compressed air impinging against a cylindrical or conical, hollow or solid, jet of paint have already been proposed in the art.

Methods of spraying paint by using the hydrostatic pressure, which are frequently referred to as "without compressed air" methods, are already known.

The inconveniences of pneumatic atomization lie essentially in the relatively high compressed-air consumption and also in the strong jet of air and atomized paint sprayed through the nozzle, so that a substantial amount of paint not deposited on the object is lost in the surrounding atmosphere while forming many eddies.

Hydrostatic spraying is objectionable in that it requires relatively high paint pressures and therefore very small atomizing orifices that are difficult to machine and exposed in service to a considerable wear by abrasion; furthermore, these small orifices are liable to clog up rapidly. On the other hand, the energy contained in the high-pressure paint jet is relatively high and causes the jet of atomized paint to travel at a very high speed, thus creating an induced air stream leading to appreciable losses of paint.

Under these conditions, various attempts have been made with a view to reduce the hydrostatic pressure, but this trend was rapidly stopped when it occurred that the jet deteriorated by allowing two jet portions to escape along its edges, these two portions being more or less separated by a central portion. Now these lateral jet portions are not properly atomized and produce two highly objectionable paint concentrations.

Various attempts for improving the hydrostatic atomization, notably by modifying the shape of the projection device, did not yield really significant results.

However, better results were obtained by modifying the paint jet issuing from the hydrostatic atomization nozzle by using jets of compressed air or, still better, by causing this paint jet to be carried along by a pair of parallel air jets of same direction and shape as, and surrounding and holding, the paint jet. Thus, the proper shape of the hydrostatically atomized jet is preserved and the atomization is slightly improved, and a hydrostatic atomization improved by the compressed air affording the use of lower paint pressures and also of larger jet orifices was obtained.

SUMMARY OF THE INVENTION

The method according to the present invention is a pneumatic atomization method applied to a paint jet issuing from a spray nozzle identical with those utilized for the hydrostatic atomization, that is, a paint jet having the shape of a flat sheet widening out to a fan shape. At the low paint pressures implemented, which are of the order of 1 to 5 bars, and as already explained in the foregoing, the flat jet is destroyed by roughly atomizing its central portion while the two lateral portions of the paint jet are relatively thick and still less atomized than the central portion.

To avoid this inconvenience, this fan-like jet is atomized pneumatically and for this purpose a jet of compressed air having likewise a fan configuration is concentrated around the paint delivery nozzle with a force sufficient to produce the desired paint atomization.

This concentration of the compressed air energy around the paint nozzle affords a satisfactory paint atomization by using compressed air under a pressure of 1 to 4 bars, but preferably of the order of 3 bars, with an output of 3 to 9 cubic meters per hour, and preferably 4 cubic meters per hour.

To simplify the following disclosure, the term "flat jet nozzle" will be used throughout to designate the paint nozzle; this nozzle is provided in a manner known per se with a blind hole formed with a semi-spherical or elliptical bottom open by a dihedron-shaped cut having its edge perpendicular to the axis of the hole and coincident or nearly coincident with the center of the sphere, the axis of said hole lying in the dihedron bisecting plane.

The front portion of the flat jet nozzle consists of a spherical cap having its center coincident with the axis of said blind hole, said spherical cap having a rearward extension in the form of a taper beyond the half-planes of said dihedron.

The method of improving the hydrostatic atomization by means of two sheets of compressed air driving and wrapping the paint jet issuing from the flat jet nozzle is not sufficient, by itself, for producing a satisfactory pneumatic atomization. The jets of compressed air impinging on the frustoconical surface of the nozzle form producing the fan-shaped jets associated with the paint jet are not powerful enough and have no suitable mode of action. Nevertheless, they are maintained in the method of this invention on account of their wrapping action which prevents the backflow of paint particles towards the nozzle and the air jet head, this protecting the latter from premature soiling.

With the spray nozzle thus protected, the paint jet is atomized by using jets of compressed air impinging directly on said paint sheet issuing from the nozzle.

Consequently, the method of this invention consists in utilizing a flat jet of paint under a pressure of 1 to 5 bars, in combination with two systems of compressed air jets; one compressed air jet system being regarded as the indirect jet system and consisting of two sheets parallel to the fan-shaped paint jet issuing from the nozzle while wrapping same, end the other compressed air jet system is caused to strike the paint jet directly as it emerges from the nozzle and has a power sufficient to atomize the paint while assisting of course the first jet system for constituting therewith the final jet consisting of a mixture of air and atomized paint.

The above-described method is attended by the following advantages:

(1) The low paint pressure facilitates greatly the spray gun feed which may be obtained either by using a simple pneumatic pump operating at a input-output ratio of 1:1 or using a pressurized reservoir, or alternatively by picking up the paint feed from a paint distributor. In this last case, the paint is supplied under a pressure above 4 bars.

(2) The low paint pressure permits of utilizing "flat sheet nozzles" of relatively large cross-sectional passage area, thus avoiding the clogging and premature wear thereof.

(3) The high paint pressures hazardous to the operators are safely eliminated, for it is known that a jet of paint under high pressure is always likely to cause paint to be injected through the skin.

(4) The compressed air consumption is reduced to one-fourth or even less of the normal consumption of a pneumatic spray gun, thus reducing the cost of installing the air compressor and at the same time the power consumption.

(5) The low power of the jet of atomized paint ensures a maximum efficiency of the paint deposit formed on the article to be painted and a minimum dispersions of paint particles not deposited in the atomsphere of the paint room; the latter may be provided with a weaker ventilation system, which also means a lesser cost for heating the ventilation air.

The pneumatic paint atomization spray gun for carrying out the method of this invention is characterized in that it comprises a "flat jet" paint atomizing nozzle of the type utilized in paint spray guns operating according to the hydrostatic atomization principle but having considerably larger nozzle orifices, vent holes for compressed air jets formed symmetrically in relation to the flat jet of paint directed towards the front frustoconical surface of the paint atomizing nozzle and widening thereon to produce fan-like jets of compressed air surrounding and accompanying the paint jet, and other vent holes for additional compressed air jets disposed symmetrically to the flat paint jet and directed towards said flat paint jet for atomizing same.

The pressure of the atomizing compressed air is of the order of 1 to 4 bars, and preferably of the order of 3 bars, and its output is of the order of 3 to 9 cubic meters per hour, and preferably of the order of 4 cubic meters per hour.

BRIEF DESCRIPTION OF THE DRAWINGS

Several forms of embodiment of the invention will now be described with reference to the accompanying drawings, in which.

DESCRIPTION OF THE PREFERRED EMBODIMENT

Figure 7:
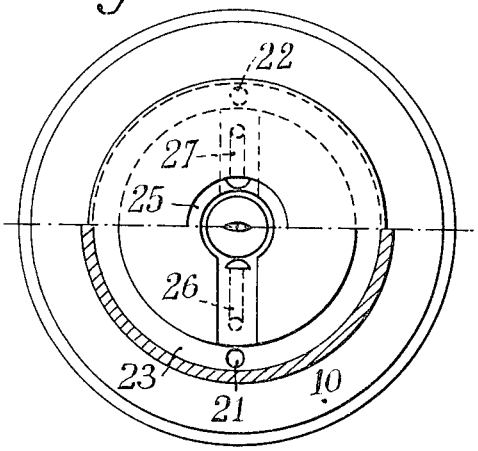

The atomization or spray gun illustrated in FIG. 7 comprises in the conventional manner inlets 1 for the paint and 2 for the compressed air, and a trigger 3 controlling the compressed-air valve 4 and the paint needle valve 5. Thus, the paint output can be adjusted by means of a milled knob 6 acting as a stop to the paint needle-valve 5. It is worth pointing out that this mode of adjusting the paint output can be contemplated with the method of the present invention, but not with hydrostatic pressure atomizing systems, due to the excessive pressure implemented in this last case.

Figure 1:
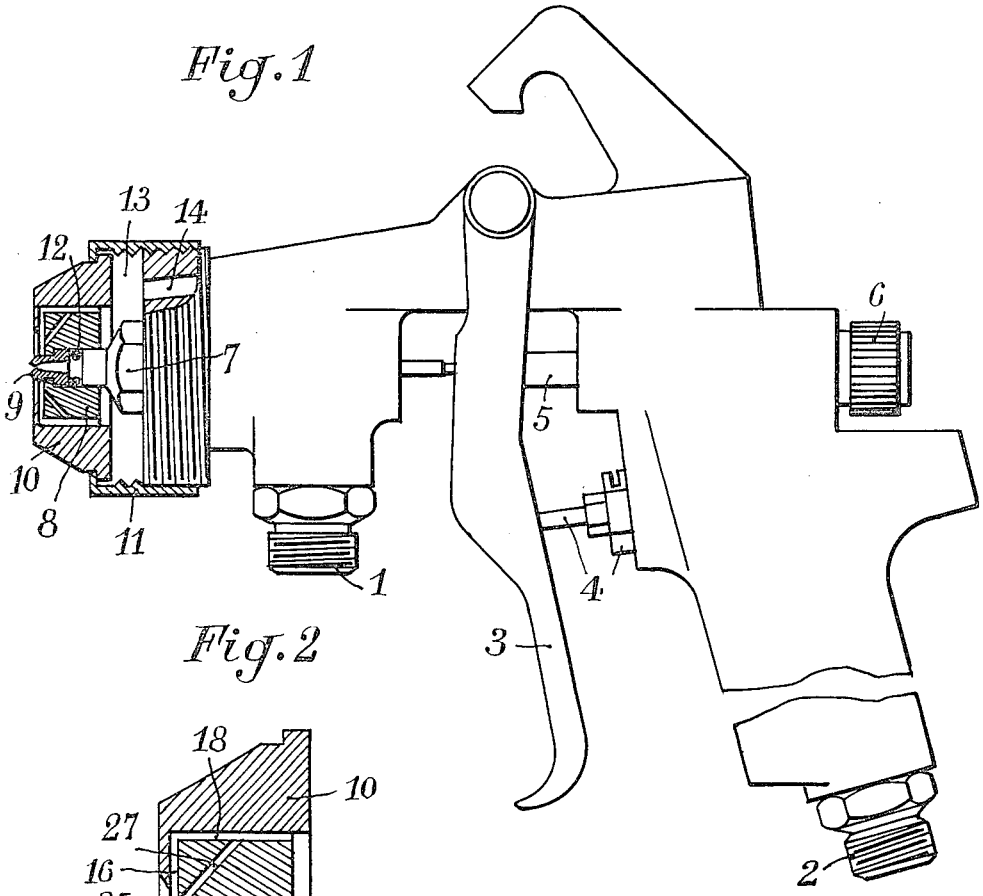
FIG. 1 is a side elevational view of a spray gun of which the spray head is shown in longitudinal section.

The paint spray gun according to this invention comprises a spray head shown in section in FIG. 1. This head incorporates an intermediate nozzle 7 in which the seat of the needle valve is formed; secured to this intermediate nozzle 7 is the actual nozzle comprising two portions, namely a body 8 and an insert 9. In the following disclosure the term "nozzle" will be used for designating the assembly formed by these two members cemented to each other. As a rule, the insert 9 consists of tungsten carbide or any other suitable abrasion-resistant material. In the case of a flat-jet nozzle, it comprises a special-shaped orifice described hereinafter. It may be emphasized that due to the low pressure values implemented, in comparison with those required for hydrostatic spraying, the wear and tear is reduced considerably and therefore it is possible to make the nozzle from one single piece of suitably resistant material.

The nozzle 8 is covered with a cap 10 secured to the spray gun body by means of a round nut 11 so as to clamp the nozzle 8 to the intermediary nozzle 7 while compressing the seal 12.

The compressed air is supplied to chamber 13 via a passage 14. As in all spray guns, the trigger 3 opens the air valve 4 before unseating the needle valve 5 for delivering paint to the spray head.

The shape of the nozzle and head may vary according to the air jets provided for producing the two desired effects, namely, on the one hand the wrapping of the paint jet, and on the other hand the atomization of this jet.

Figure 2:
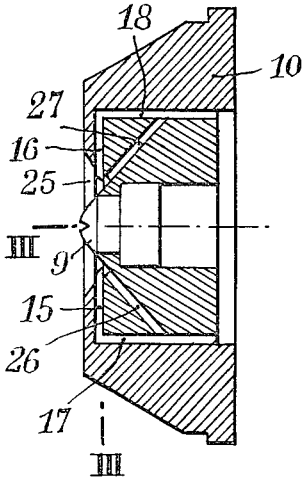
FIG. 2 is a longitudinal section showing an atomization or spray nozzle.
Figure 3:
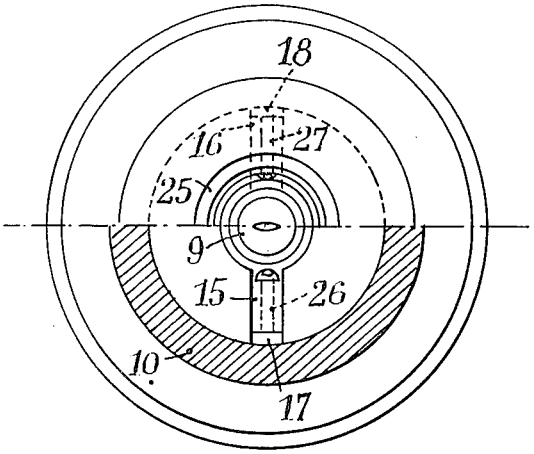
FIG. 3 shows the upper half of the spray nozzle of FIG. 2 in elevation and the lower half thereof in section taken along the line III—III of FIG. 2.

FIGS. 2 and 3 illustrate a paint spray head of the type fitted to the spray gun shown in FIG. 1.

Milled in the front surface of nozzle 8 are a pair of rectangular-sectioned grooves 15, 16 having a width of 2 to 4 mm and a depth of 0.4 to 1 mm; however, this shape may differ according to the shape contemplated for the jets of compressed air. When the cap 10 is fitted to the nozzle, it provides in conjunction with the upper surface of the groove a rectangular-sectioned channel opening in front of the frustoconical surface of the nozzle.

Figure 4:
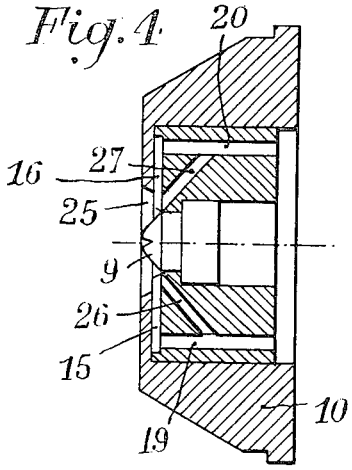
FIGS. 4 and 5, 6 and 7 illustrate modified forms of embodiment of the spray nozzle, which correspond to FIGS. 2 and 3, respectively.
Figure 5:
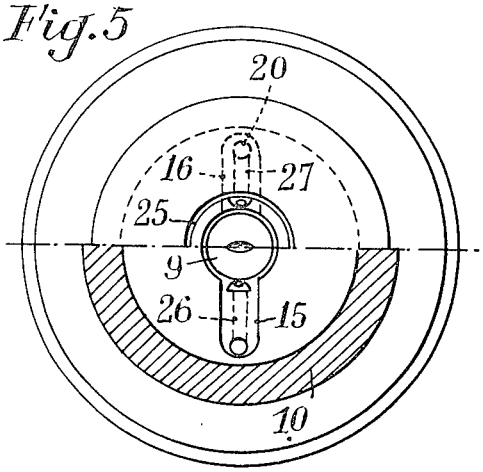
Figure 6:
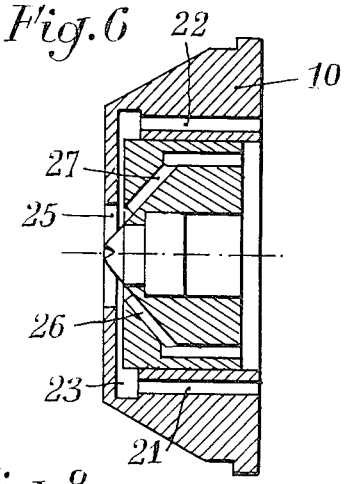

The grooves 15, 16 may be supplied with compressed air through various means, such as milled channels 17 and 18 formed in the outer cylindrical nozzle surface, as illustrated in FIGS. 2 and 3, or alternatively orifices formed through the nozzle as shown in FIGS. 4 and 5, or still orifices 21, 22 formed through the head 18 and opening into a circular groove 23, as illustrated in FIGS. 6 and 7.

The orifice 25 formed in the head 10 and through which the air and paint are projected may be circular or elongated. In the case of an elongated orifice, the major axis of the orifice should lie in the plane of the jet of paint, i.e. normally to the axis of grooves 15 and 16, this last-mentioned axis being perpendicular, by construction, to the edge of the dihedron opening the outlet orifice positioning the nozzle in the head.

The jets of compressed air delivered through the nozzle channels 15 and 16 are thus caused to spread or widen out as they impinge on the frustoconical surface of the nozzle forming the air sheet developing fan-wise and enveloping the paint jet as it is projected from the nozzle. Compressed air nozzles or jets as illustrated at 26 and 27 are caused to strike the paint jet directly in order to atomize same.

Figure 8:
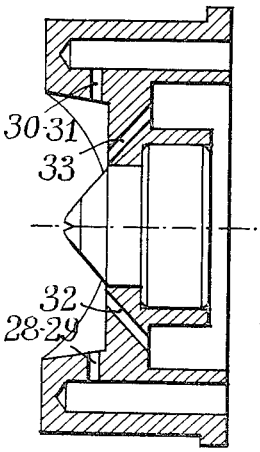
FIGS. 8 and 9 illustrate in longitudinal section and in elevation another modified embodiment.
Figure 10:
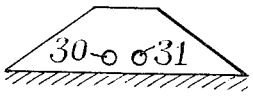
FIG. 10 is a section taken along the line X—X of FIG. 9.
Figure 9:
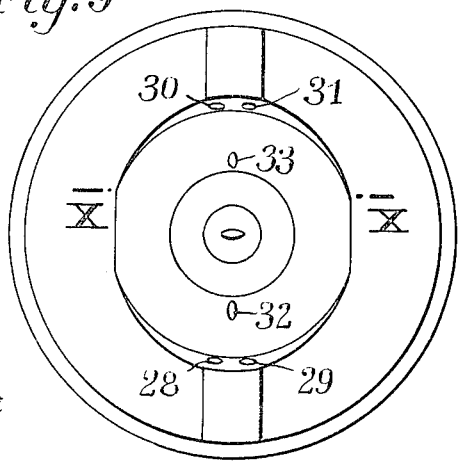

In the form of embodiment illustrated in FIGS. 8 to 10, the atomizing head ocomprises pairs of jets or nozzles 28, 29 and 30, 31 directed towards the nozzle cone and widening out to form the enveloping air jet. The jets issuing from the inclined nozzles 32, 33 are directed straight onto the paint jet for atomizing same.

Figure 11:
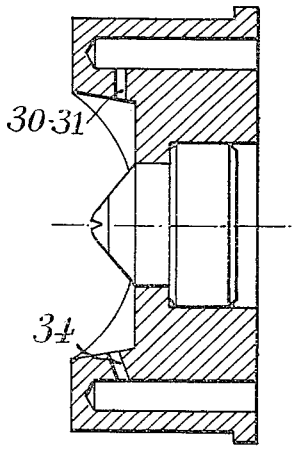
FIGS. 11 to 13, 14 to 16, 17 to 19 and 20 to 22 are views similar to FIGS. 8 to 10, respectively, but showing other modified embodiments of spray nozzles.
Figure 12:
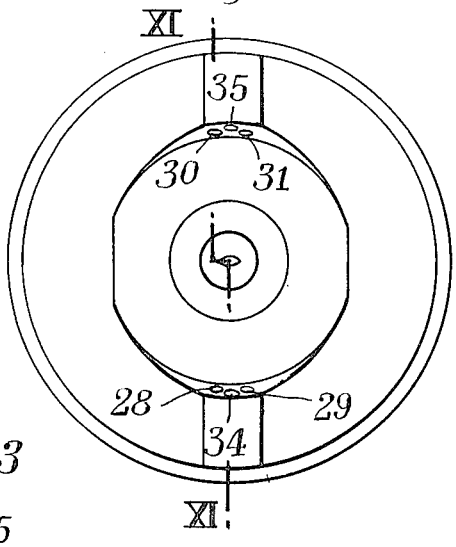
Figure 13:
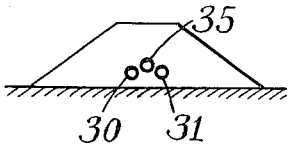

The spray head illustrated in FIGS. 11 to 13 is similar to the preceding one but the atomizing nozzles 34 and 35 are less inclined to the main axis of the spray head, thus forming a wider jet of atomized paint.

Figure 14:
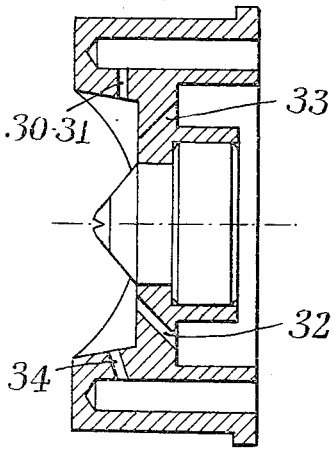
Figure 15:
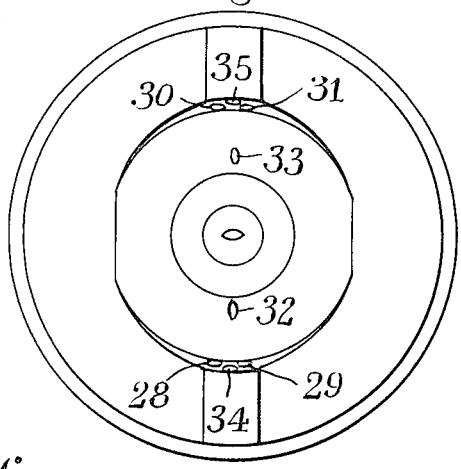
Figure 16:
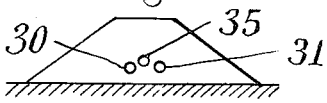

The atomizing head shown in FIGS. 14 to 16 comprises eight jet holes. In fact, it is a combination of the two heads described in the foregoing and illustrated in FIGS. 8 to 10 and 11 to 13, respectively. In the arrangement of FIGS. 14 to 16, four jet holes form the enveloping sheet and four other jet holes converge by pairs before impinging on the paint sheet issuing from the atomizing nozzle. This combination of atomizing jets afford a satisfactory distribution in the wide jet.

Figure 17:
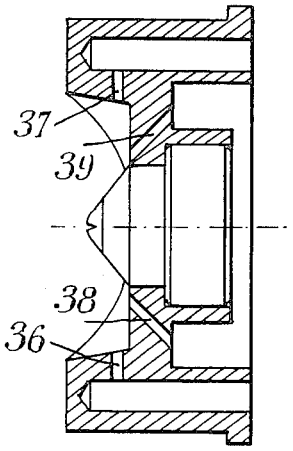
Figure 18:
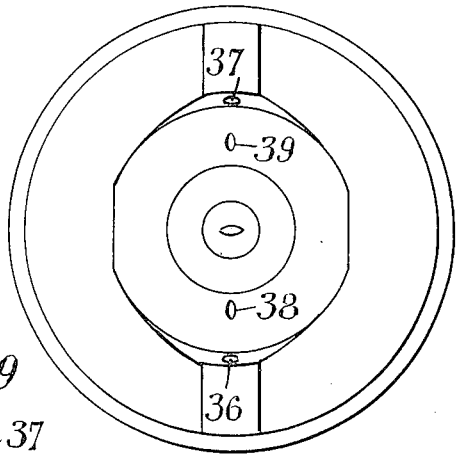
Figure 19:
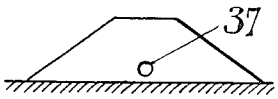

FIGS. 17 to 19 illustrate another modified embodiment wherein the jet holes are so arranged that the enveloping air sheet is obtained as a consequence of the convergence of two concurrent air jets 36 and 37, on the one hand, and 38 and 39, on the other hand, thus forming a flattened jet tending to surround the nozzle.

In fact, with this head it is not possible to produce the pneumatic atomization of the jet of paint, but an envelopping air jet having a shape other than that resulting from the flattening air jets on the nozzle tapered surface is obtained.

Figure 20:
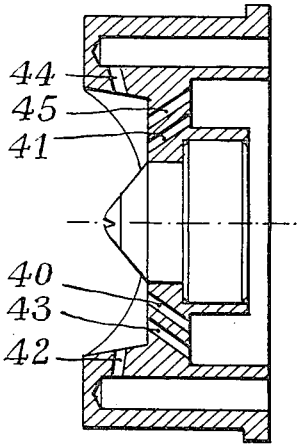
Figure 21:
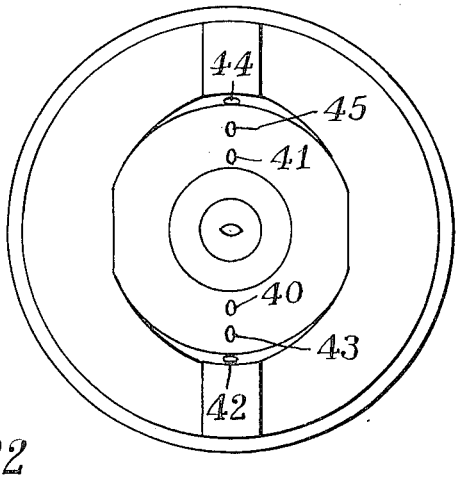
Figure 22:
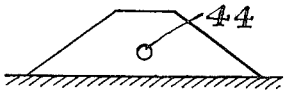

To atomize the paint jet, and as shown in FIGS. 20 to 22, it is necessary to add a pair of vent holes 40 and 41 producing air jets passing through the air sheet resulting from the convergence of jets 42, 43, on the one hand, and 44, 45, on the other hand.

Of course, it will readily occur to those conversant with the art that the various forms of embodiment of the invention which are described and illustrated herein are given by way of example, not of limitation, since many modifications and changes may be brought thereto without departing from the basic principles of the invention; thus, more particularly, the two air jet arrangements the combination of which provides the desired result may be formed through any other suitable means without departing from the present invention.

What is claimed as new is:

1. Method of pneumatically atomizing liquids, comprising the steps of utilizing a flat jet of paint under a pressure of 1 to 5 bars, in combination with two systems of compressed air, one system being an indirect one and comprising two sheets parallel to the fan-shaped paint sheet issuing from the nozzle and between which it is encompassed, the other system, consisting of two symmetric jets in relation to said flat jet of paint, inclined in the direction of spraying of this jet and directed directly against said paint jet encompassed by two sheets of compressed air, having a power sufficient to pass through said sheets of compressed air, penetrate into said paint jet, and atomize said paint jet, and cooperating with said first compressed air system to constitute the final jet forming a mixture of air and atomized paint encompassed between two parallel sheets of compressed air.

2. A method as recited in claim 1, wherein the compressed-air pressure ranges from about 1 to about 4 bars, with an output of about 3 to about 9 cubic meters per hour.

3. A method as recited in claim 1, wherein the compressed-air pressure is about 3 bars with an output of about 4 cubic meters per hour.

4. A paint spraygun of the pnuematic atomization type comprising a flat-jet paint atomization cap of the type used in hydrostatic atomization paint sprayguns, said cap having a frustoconical front surface, an orifice for issuing a flat jet of paint and nozzle orifices, first vent means for producing compressed air jets disposed symmetrically in relation to the flat jet of paint from said orifice and which are directed into impinging relation towards said frustoconical front surface of said paint atomization cap and spreading thereon to produce fan shaped jets of compressed air surrounding and accompanying the paint jet, and second vent means for producing other jets of compressed air disposed symmetrically in relation to said flat jet of paint, said other jets of compressed air being directed to penetrate the air surrounding the paint jet to atomize said flat jet of paint while enshrouded by two sheets of compressed air.

* * * * *